US008245872B2

(12) United States Patent
Hanot et al.

(10) Patent No.: US 8,245,872 B2
(45) Date of Patent: Aug. 21, 2012

(54) PLASTIC BOTTOM FOR PACKAGE

(75) Inventors: Dominique Hanot, Vouvry (CH); Stéphane Mathieu, Vouvry (CH)

(73) Assignee: Aisapack Holding S.A., Vouvry (CH)

( * ) Notice: Subject to any disclaimer, the term of this patent is extended or adjusted under 35 U.S.C. 154(b) by 710 days.

(21) Appl. No.: 12/300,736

(22) PCT Filed: May 15, 2007

(86) PCT No.: PCT/IB2007/051844

§ 371 (c)(1),
(2), (4) Date: Jan. 16, 2009

(87) PCT Pub. No.: WO2007/138514

PCT Pub. Date: Dec. 6, 2007

(65) Prior Publication Data

US 2009/0154848 A1 Jun. 18, 2009

(30) Foreign Application Priority Data

Jun. 1, 2006 (EP) ..... 06114812

(51) Int. Cl.
*B65D 6/28* (2006.01)
*B65D 8/04* (2006.01)
*B65D 30/16* (2006.01)

(52) U.S. Cl. ..... 220/613; 220/611; 220/612; 220/623; 215/370; 215/376; 215/377; 383/121; 383/121.1

(58) Field of Classification Search ..... 220/608, 220/611, 612, 613; 215/370, 376, 377; 383/104, 383/121, 121.1
See application file for complete search history.

(56) References Cited

U.S. PATENT DOCUMENTS

| | | | | |
|---|---|---|---|---|
| 3,043,461 | A * | 7/1962 | Glassco | 215/375 |
| 3,700,018 | A * | 10/1972 | Goglio | 220/612 |
| 4,762,249 | A * | 8/1988 | Fortuna et al. | 220/359.4 |

FOREIGN PATENT DOCUMENTS

| | | |
|---|---|---|
| AT | 293 944 | 10/1971 |
| EP | 1 362 797 A2 | 11/2003 |
| FR | 1 593 395 | 5/1970 |
| FR | A-1 593 395 | 5/1970 |
| FR | 2 076 112 | 10/1971 |
| WO | 2005/105601 | 11/2005 |

OTHER PUBLICATIONS

English Translation of International Preliminary Report on Patentability (IPRP)—Chapter II, Dec. 1, 2008.
International Search Report for PCT/IB2007/051844, mailed Oct. 16, 2007.

* cited by examiner

*Primary Examiner* — Anthony Stashick
*Assistant Examiner* — Madison L Wright
(74) *Attorney, Agent, or Firm* — Nixon & Vanderhye P.C.

(57) ABSTRACT

The invention relates to a rigid or semirigid plastic part designed to form the bottom of a package whose side wall consists of a laminated film. The plastic part has a central axis and includes the following features: a peripheral welding zone designed to contact and be welded to the inside surface of the side wall; a convex inside face and a concave outside face; the inside face and the outside face each comprise a zone whose centre is on the axis and which is designed to contact a tool used to attach the part to the side wall; and a profile at least partially defined by a curve. The invention also relates to a package having a bottom consisting of the plastic part.

15 Claims, 3 Drawing Sheets

PLASTIC BOTTOM FOR PACKAGE

This application is the U.S. national phase of International Application No. PCT/IB2007/051844, filed 15 May 2007, which designated the U.S. and claims priority to European Application No. EP 06114812.8, the entire contents of each of which are hereby incorporated by reference.

FIELD OF THE INVENTION

The field of the invention is packages comprising a side wall consisting of a laminated film, and a bottom welded to said wall.

PRIOR ART

Packages corresponding to the above definition already exist.

Examples that may be cited include patent documents AT 293 944 and EP 1 362 797.

In this type of object, the bottom must provide stability and mechanical strength and must seal the package. In particular, it must offer good resistance to deformation when a load is applied to its centre.

GENERAL DESCRIPTION OF THE INVENTION

The problem addressed by the present invention is how to improve on the prior art.

In the invention, the solution to the above problem is a rigid or semirigid plastic part designed to form the bottom of a package whose side wall consists of a laminated film, said part having a central axis and comprising the following features:

a. A peripheral welding zone designed to contact and be welded to the inside surface of said side wall;
b. A convex inside face and a concave outside face;
c. The inside face and the outside face each comprising a zone, whose centre is on said axis and which is designed to contact a tool used to attach the part to said side wall; and
d. A profile at least partially defined by a curve which may be an arc of a circle of radius greater than or equal to half the semidiameter of the part.

The dependent claims describe particularly advantageous embodiments of the invention.

The part according to the invention may advantageously have the following features:

minimal weight
minimal wasted volume
few or no ribs
little deformation of the bottom under 40 N
no rotation of the welding zone
good pressure resistance at 3 bar.

DETAILED DESCRIPTION OF THE INVENTION

The invention is described in more detail below by means of examples illustrated in the following figures.

LIST OF REFERENCE NUMBERS USED IN THE FIGURES

Figure 1:
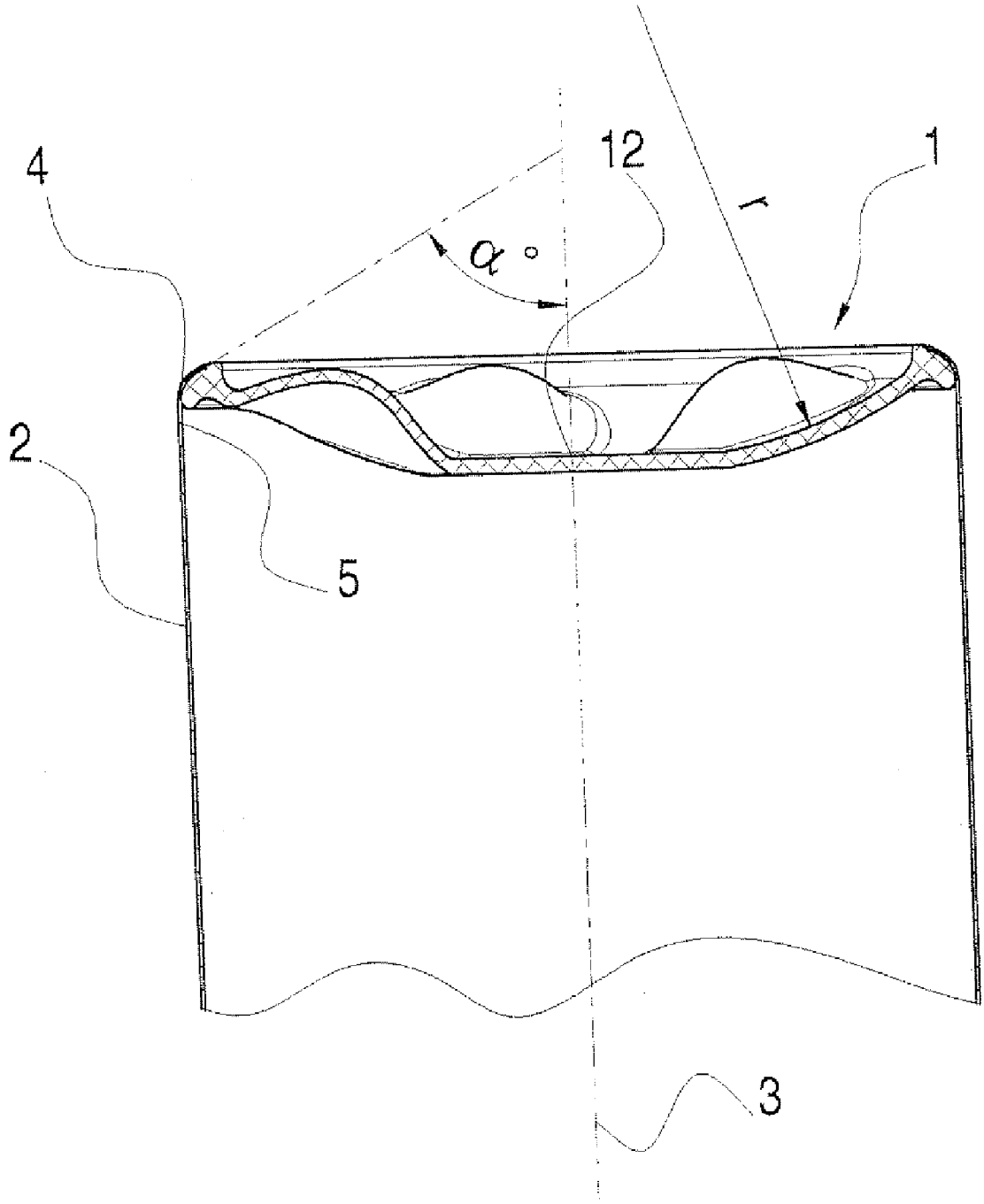
FIG. 1 shows a section of a package comprising a bottom according to the invention.
Figure 2:
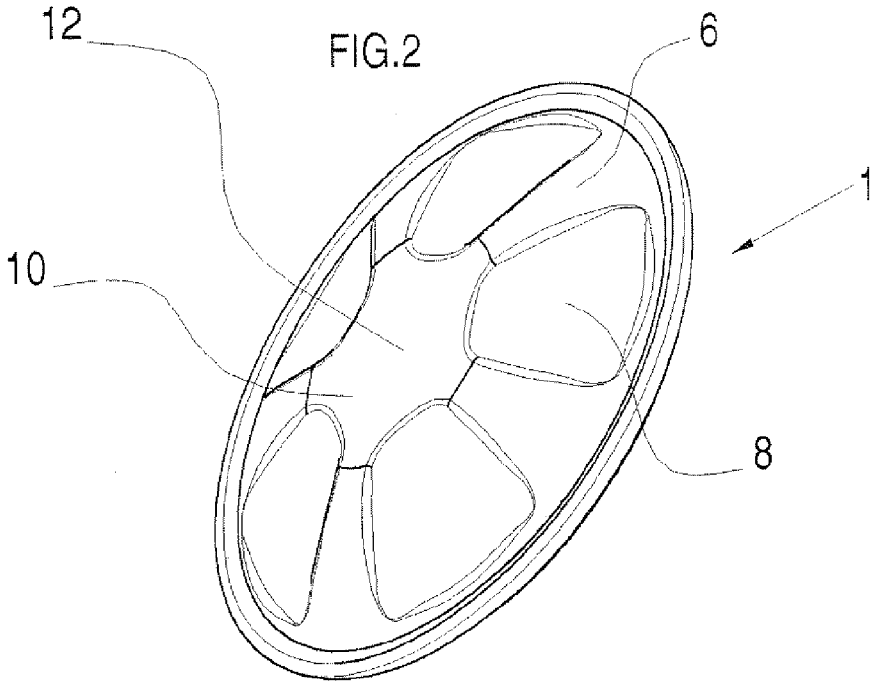
FIG. 2 illustrates the inside face of a bottom according to the invention.
Figure 3:
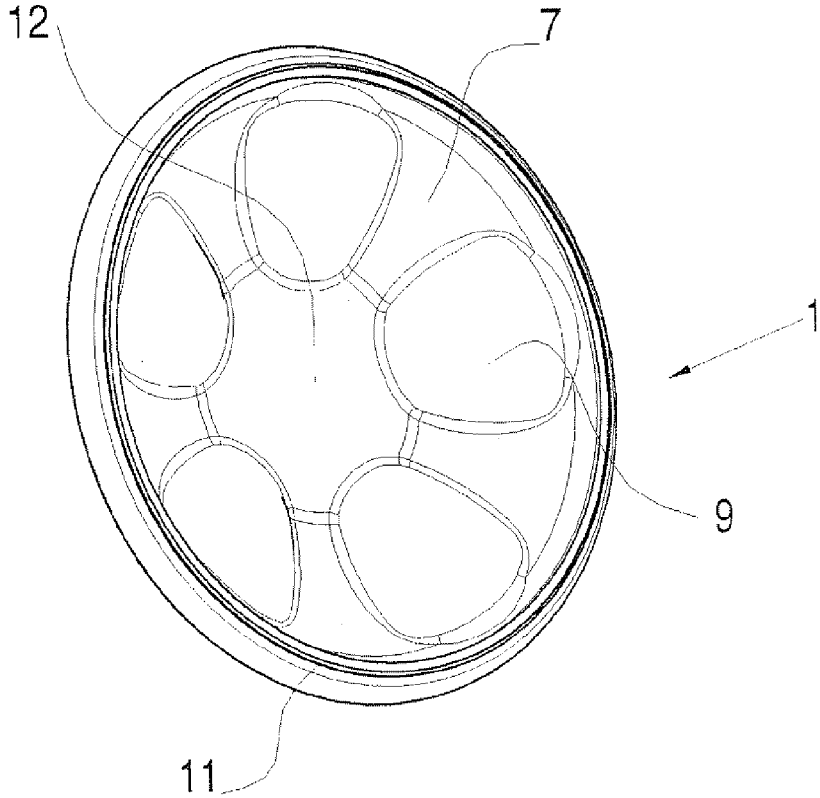
FIG. 3 illustrates the outside face of the bottom shown in FIG. 2, and shows an odd number of humps, i.e., five humps.
Figure 4:
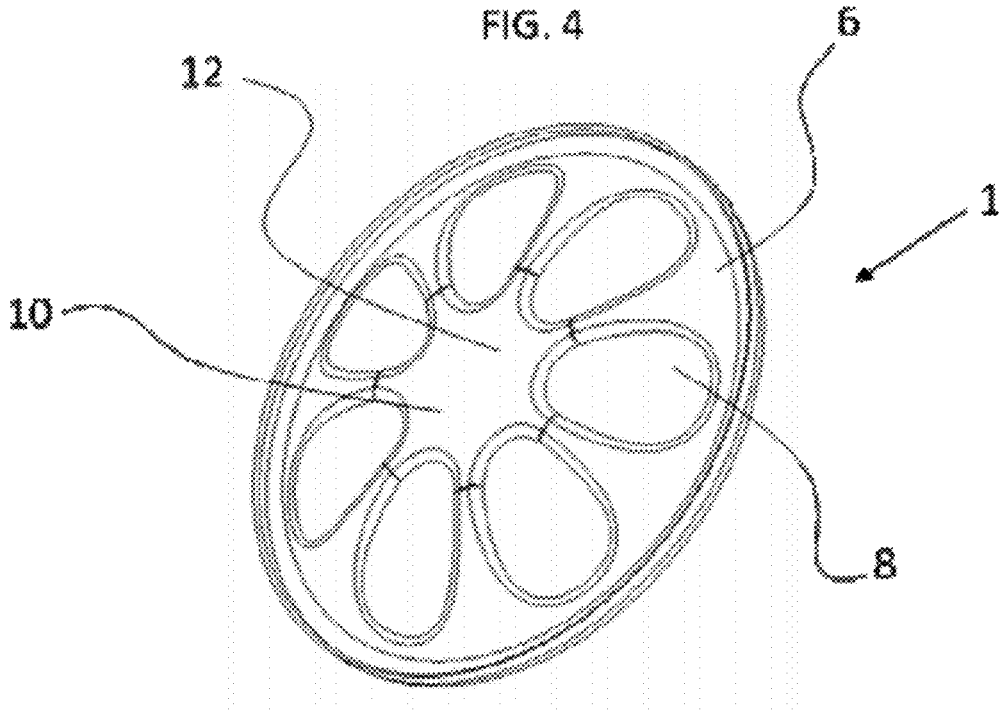
FIG. 4 illustrates the inside face of a bottom according to the invention.
Figure 5:
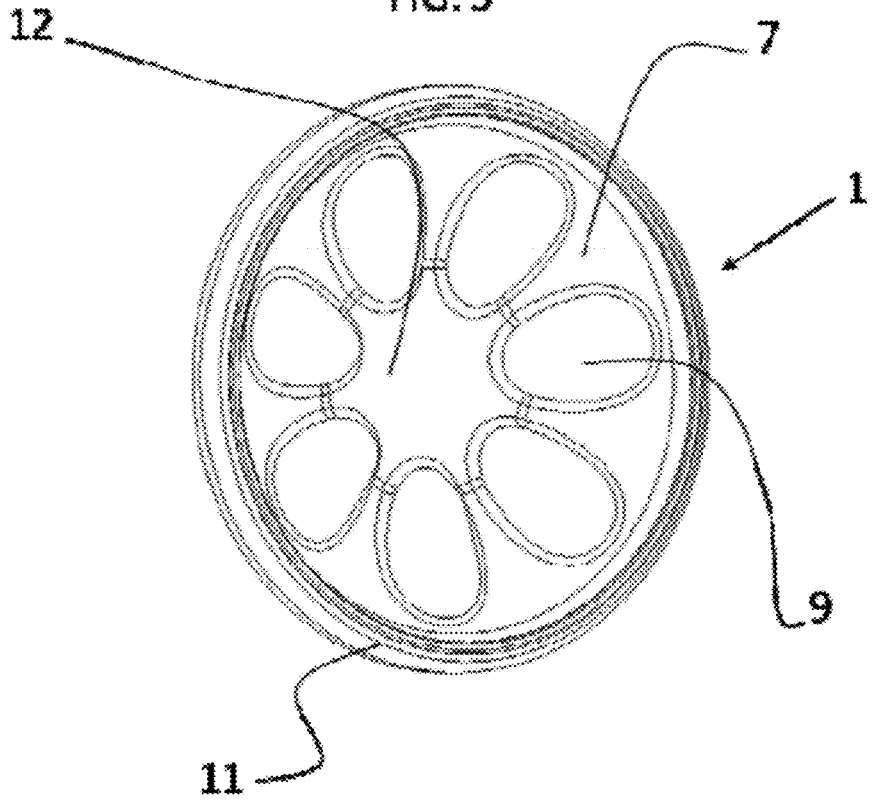
FIG. 5 illustrates the outside face of the bottom shown in FIG. 4, and shows an odd number of humps, i.e., seven humps.

1) Bottom
2) Side wall
3) Axis
4) Welding zone
5) Inside surface of the side wall
6) Convex inside face
7) Concave outside face
8) Cavity
9) Hump
10)Contact zone, inside face
11)Contact zone, outside face
12)Centre of part The bottom 1 illustrated in the figures is circular and has an outside diameter of between 35 and 63.5 mm. Its height is usually less than 35 mm.

The bottom perimeter may of course be of a different shape, for example, circular, oval, or polygonal.

In one embodiment, the bottom possesses a stiffness that allows an at least partial transformation of the concave face into a convex face and vice versa in the direction of the force and/or pressure exerted on one of the faces.

The bottom 1 preferably has a profile whose curve is a circle whose radius r is between one and two times the outside radius of the bottom 1. Its height is usually between 10 and 25% of its diameter. This profile is preferably truncated at its centre and followed by a flat zone whose diameter is equal to 30 to 50% of its outside diameter to make it easy to handle from the inside. The humps 9 (which can be an odd number such as three, five, or seven), if necessary, represent preferably from 30 to 60% of its projected area. The outside handling zone may be a central disc or a centred annulus of width approximately 0.5 mm and of internal radius approximately equal to 85 to 90% of the outside diameter of the bottom. The bottom thus defined has a characteristic thickness of about 0.8 to 1.5 mm depending on its outside diameter and its height. The humps 9 may be thinner, about 20%. The weld angle $\alpha$ is typically between 45 and 75°, but can be from 5° to 150°.

As an example embodiment, a bottom of outside diameter of 49.1 mm, height 7.5 mm, weld angle $\alpha$=60°, circular curvature of radius r=30 mm truncated by a flat central zone of diameter 20 mm and an annulus on its underside of inside diameter of 43.5 mm for a width of 0.5 mm and with humps 9 occupying approximately 50% of its area meets all the technical features defined above. This bottom 1 has a general thickness of 1 mm, and of 0.8 mm in the humps 9.

The bottom also includes a flat zone at its bottom-most extremity for the stability of the package. In the previous case, this stability is provided by the annulus which is used for the external handling of the bottom 1.

The bottom 1 described above is typically injection moulded. It can also be produced by compression moulding or by thermoforming.

It is made of a thermoplastic, examples being PE, PP or PET. It may also be multilayer to contribute to the overall barrier qualities of the package.

It is attached to the film which forms the body of the package by hot-air welding and/or by induction, depending on whether the film used for the body does or does not contain aluminium.

The resulting package has excellent stability. It has good static strength (under a central load of 40 N, pressure resistance) and impact strength (drop test). It also exhibits the properties required for sterilization by liquid or by air.

The invention claimed is:

1. A rigid or semirigid plastic part designed to form a bottom of a package whose side wall consists of a laminated film, wherein said part has a central axis and comprises:

a. a peripheral welding zone designed to contact and be welded to only an inside surface of said side wall;

b. a convex inside face and a concave outside face;

c. the inside face and the outside face each comprising a zone whose centre is on said axis and which is designed to contact a tool used to attach the part to said side wall; and d. a profile at least partially defined by a curve, that is truncated at its centre and followed by a flat zone whose diameter is equal to 30 to 50% of its outside diameter to make it easy to handle from the inside.

2. A part according to claim 1, whose profile is at least partially defined by an arc of a circle of radius (r) greater than or equal to half a semidiameter of the part.

3. A part according to claim 1 comprising humps on its outside face.

4. A part according to claim 3, in which the humps are distributed around an annular zone whose centre is on said axis.

5. A part according to claim 4, comprising an odd number of humps.

6. A part according to claim 5, in which the number of humps is 3, 5, or 7.

7. A part according to claim 3, in which a ratio of an area occupied by the humps to a total area of the part is between 0 and 70%.

8. A part according to claim 1, possessing a stiffness that allows an at least partial transformation of the concave face into a convex face and vice versa in a direction of a force and/or pressure exerted on one of the faces.

9. A part according to claim 1, in which said welding zone comprises a portion that forms an angle of from 5° to 150° with said axis.

10. A part according to claim 1, in which said zone of external contact is a planar annulus with a width of at least 0.3 mm.

11. A part according to claim 1, in which the inside face, in its portion which is intended to contact a product, has a curvature which is such that its derivative at any point is continuous.

12. A part according to claim 1, whose perimeter is circular.

13. A part according to claim 1, whose perimeter is oval.

14. A part according to claim 1, whose perimeter is polygonal.

15. A package comprising a side wall consisting of a wrapped laminated film and a bottom consisting of a part according to claim 1.

* * * * *